US009607558B2

(12) United States Patent
Wallener et al.

(10) Patent No.: US 9,607,558 B2
(45) Date of Patent: Mar. 28, 2017

(54) POWER MANAGEMENT FOR MODULATED BACKLIGHTS

(71) Applicant: Dolby Laboratories Licensing Corporation, San Francisco, CA (US)

(72) Inventors: Damir Wallener, Duncan (CA); Neil W. Messmer, Langley (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/186,263

(22) Filed: Feb. 21, 2014

(65) Prior Publication Data

US 2014/0168287 A1 Jun. 19, 2014

Related U.S. Application Data

(62) Division of application No. 13/119,989, filed as application No. PCT/US2009/056958 on Sep. 15, 2009, now abandoned.

(60) Provisional application No. 61/101,448, filed on Sep. 30, 2008.

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/36* (2013.01); *G09G 3/342* (2013.01); *G09G 2320/0646* (2013.01); *G09G 2320/0686* (2013.01); *G09G 2330/021* (2013.01); *G09G 2360/16* (2013.01)

(58) Field of Classification Search

CPC ..... G09G 3/3406; G09G 3/3696; G09G 5/10; G09G 2320/0233; G09G 2320/0646; G09G 3/36; G09G 3/342; G09G 2320/0686; G09G 2360/16; G09G 2330/021

See application file for complete search history.

(56) References Cited

U.S. PATENT DOCUMENTS

| | | | |
|---|---|---|---|
| 6,621,482 | B2 | 9/2003 | Fuller |
| 7,036,025 | B2 | 4/2006 | Hunter |
| 2003/0018115 | A1 | 1/2003 | Massey |
| 2003/0146897 | A1 | 8/2003 | Hunter |
| 2005/0052446 | A1 | 3/2005 | Plut |
| 2005/0110740 | A1 | 5/2005 | Linzmeier |

(Continued)

FOREIGN PATENT DOCUMENTS

| | | |
|---|---|---|
| EP | 1717792 | 11/2006 |
| JP | 2002311925 | 10/2002 |

(Continued)

*Primary Examiner* — Andrew Sasinowski
*Assistant Examiner* — Brent D Castiaux

(57) ABSTRACT

Power levels of a backlight are adjusted in a number of ways and based on a number of criteria. The adjustments result in a lower power consumption and, in some cases, may enhance audience attention to important objects in a scene. The adjustments comprise, for example, a combination of ramping down power (lowering final display brightness) in concert with corresponding compensatory LCD adjustments (increasing final display brightness). The adjustments may also include, for example, system dimming after ramp down/LCD adjustments are exhausted, or the shifting of an LDR2HDR curve.

22 Claims, 3 Drawing Sheets

(56) References Cited

U.S. PATENT DOCUMENTS

2005/0275605 A1* 12/2005 Kwon ..... G09G 3/2022 345/63
2005/0275651 A1 12/2005 Plut
2006/0001658 A1 1/2006 Plut
2006/0103621 A1* 5/2006 Feng ..... G09G 3/3426 345/102
2006/0126932 A1 6/2006 Eschbach
2006/0127081 A1 6/2006 Lee
2006/0250525 A1* 11/2006 Plut ..... G06F 1/3203 348/607
2007/0064162 A1 3/2007 Yamamoto
2007/0146344 A1* 6/2007 Martin ..... G06F 1/3215 345/173
2007/0216311 A1* 9/2007 Cernasov ..... G09G 3/3426 315/3
2007/0285379 A1* 12/2007 Jung ..... G09G 3/342 345/102
2007/0285382 A1* 12/2007 Feng ..... G09G 3/3426 345/102
2008/0074372 A1* 3/2008 Baba ..... G09G 3/3406 345/89
2008/0218468 A1 9/2008 Kim
2009/0015755 A1 1/2009 Bang
2009/0278786 A1* 11/2009 Chan ..... G09G 3/3406 345/102

FOREIGN PATENT DOCUMENTS

JP 2004-184937 7/2004
JP 2004-198512 7/2004
JP 2005-346032 12/2005
JP 2007-140436 6/2007
WO 2006026179 3/2006

* cited by examiner

POWER MANAGEMENT FOR MODULATED BACKLIGHTS

CROSS-REFERENCE TO RELATED APPLICATIONS

This application is a divisional of, and claims the benefit of priority to, U.S. patent application Ser. No. 13/119,989 filed on Mar. 21, 2011, which is a US national application and claims benefit of PCT application PCT/US2009/056958 filed on Sep. 15, 2009, which claims the benefit of the filing date of U.S. Provisional Patent Application Ser. No. 61/101,448 filed on Sep. 30, 2008, all of which are hereby incorporated by reference in their entirety

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Field of Invention

The present invention relates to modulated backlights and more particularly to modulation and power levels of individually modulated backlights.

Description of Related Art

Dynamic range is the ratio of intensity of the highest luminance parts of a scene and the lowest luminance parts of a scene. The human visual system is capable of recognizing features in scenes which have very high dynamic ranges. For example, a person can look into the shadows of an unlit garage on a brightly sunlit day and see details of objects in the shadows even though the luminance in adjacent sunlit areas may be thousands of times greater than the luminance in the shadow parts of the scene.

To create a realistic rendering of such a scene can require a display having a dynamic range in excess of 1000:1, otherwise in a range known as High Dynamic Range (HDR). Modem digital imaging systems are capable of capturing and recording digital representations of scenes in which the dynamic range of the scene is preserved. And technologies exist for rendering high dynamic range images on displays, including displays incorporating modulated backlights.

SUMMARY OF THE INVENTION

The present inventors have realized that a significant challenge for a successful and efficient high-brightness and High Dynamic Range (HDR) display is the power consumption of a suitable backlight. High power consumption equates to increased operating costs, both in terms of energy and product lifetime/maintenance.

The present invention describes multiple devices and processes that may be incorporated into a display or control mechanisms to reduce power consumption in a backlight consisting of spatially-modulated lighting elements (e.g., LEDs) based on the image content.

Portions of both the device and method/processes may be conveniently implemented in programming on a general purpose computer, embedded control device, programmable logic, ASIC, or networked computers, and the results may be displayed on an output device connected to any of the general purpose, networked computers, or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable(s), and co-ax cable(s), etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
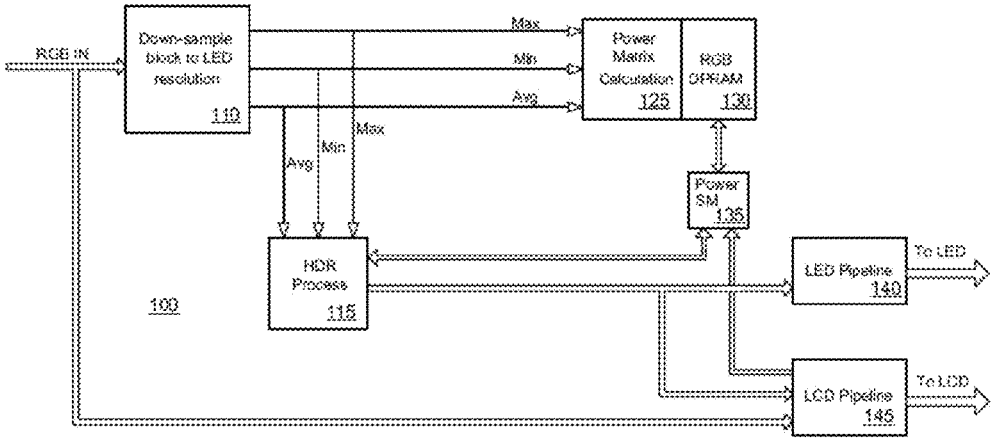
FIG. 1 is a schematic diagram of a power management system according to an embodiment of the present invention.

Referring now to the drawings, wherein like reference numerals designate identical or corresponding parts, and more particularly to FIG. 1 thereof, there is illustrated a schematic diagram of a power management system according to an embodiment of the present invention.

As shown in FIG. 1, an RGB IN signal is received by a Down-Sampler 110. The RGB IN signal comprises, for example, a signal received or processed from any of a cable TV signal, a satellite signal, television broadcast, graphics processor (e.g., RGB computer output), a network appliance/device, media players (e.g., DVD, HD-DVD, or Blu-ray devices, etc.), or other content devices, and the signal is carried, for example, in a format suitable for industry standard RGB component cables, HDMI, DVI, or wireless transmission protocol (e.g., 802.11).

The outputs from LED Pipeline 140 and LCD Pipeline 145 comprise, for example, signals that control modulation levels of a display. The modulation levels comprise, for example, modulation levels of a backlight and a front modulator. In this example embodiment, the backlight modulation levels comprise individual modulation levels of each controllable light source of a backlight, and the modulation of the front modulator comprises an amount of modulation of each pixel in the front modulator (e.g., an LCD panel).

The Downsampler 110, downsamples pixels of the RGB IN signal to a resolution of the controllable light sources of the backlight (e.g., resolution of an LED or cluster of LEDs). The resolution is defined, for example, by SW configuring the control in the calculation module (e.g., Power Matrix Calculation Module 125). A minimum (MIN), maximum (MAX), and averages (e.g., AVG) are calculated for each controllable light source.

The MAX, MIN, and AVG are provided to a Power Matrix Calculation module 125. The HDR Process module 115 is configured to determine modulation data for the backlight and front modulator. The HDR Process module 115 provides modulation data to an LED Pipeline 140 which comprises, for example, electronics and drive circuitry to energize each light source or cluster of the backlight (each light source or cluster comprises, for example, LEDs).

A matrix power resolution for power control is also defined (e.g., determined via software by calculating an amount of power to be used to energize each controllable light source of the backlight). This is performed, for example, by programming of the Power Matrix Calculation Module 125. The Power Matrix calculation module utilizes the RGB Min, MAX, and AVG luminances derived by the downsampler 110 and calculates a coarser power adjustment and the rate of change to the matrix power resolution.

A system max power is saved in memory (e.g., calculated by the Power matrix Calculation Module 125 and stored in memory) and available for other power and matrix calculations. A power State Machine (Power SM 135) monitors the actual system power and the rate of change of power for each location in the matrix. When the power exceeds a max setting, adjustments are made. The adjustments comprise, for example, adjustments to overall power allocation or a re-allocation of power amongst the individually controllable light sources. The greedy algorithm accounts for the rate of change of power to determine its response time to initiate the adjustment. The Power SM adjustments, along with backlight modulation calculations are driven to the HDR Process module 115. This enables the HDR Process module 115 to compensate for the power adjustments through its own pipeline that derives the backlight drive and the lightfield simulation. The adjustments by the Power SM are made, for example, based on total power utilized, power utilized in individual regions, the rate of change of power in a region, or the content of individual regions. For example, upon detection of an over-max power condition, the following changes in the LED and LCD output pipelines (140/145) may be implemented:

(A) Regions of the Power Matrix that utilize the most power are ramped down, and simultaneously compensated for by adjusting the LCD pixel data upwards. The adjustment is made, for example, until further adjustment would cause a color shift or otherwise have a negative visual effect on the image. The detection of the colour shift is determined in the LCD output pipeline by monitoring the RGB pixel ratio. In one embodiment, the amount of adjustment is calculated based on known physical factors such as the combination of the backlight response to power and LCD compensation. In another embodiment, a detector may provide realtime feedback which is then utilized to enhance future adjustments; and (B) Once the max of (A) has occurred, further adjustments at a system level may be implemented. For example, system (global) dimming may be performed at least until the over-max power condition is resolved. In one embodiment, compensation for an over-max power condition comprises compensating to a predetermined below-max power threshold (e.g., hysteresis) to provide a cushion to prevent immediate repeating of the over-max power routines when a next image, frame, or series of frames is just slightly brighter (or of a just slightly greater overall power consumption) than the image/frame(s) just adjusted for over-max conditions. This prevents flicker and additional motion artifacts.

In another embodiment, feedback is provided to an input of a lightfield simulation. The lightfield simulation comprises, for example, a calculation of the contribution of light levels from the individual backlights for each front modulator individually addressable location of a group of controllable element of the modulator. This lightfield simulation is then used to compensate the pixel values of the front modulator with energization levels of the individually controllable light sources of the backlight.

Figure 2A:
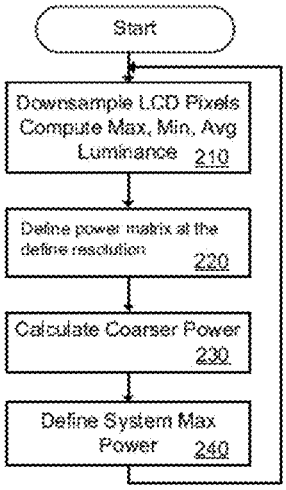
FIG. 2A is a flowchart of a power determination process according to an embodiment of the present invention.

FIG. 2A is a flowchart of a power determination process according to an embodiment of the present invention. At step 210, LCD pixels of an input signal (e.g., input RGB signal) are downsampled to a resolution of a backlight light source, and statistical data, such as Max, MM, and Average luminance is calculated. The statistical data is utilized to determine, for example, power for each matrix grid of the backlight, system power parameters such as coarse power steps (rate of change)([step 230—Define power matrix at the define resolution]), and a system total power (step 240). The process is repeated for each image or frame of a video to be displayed.

Figure 2B:
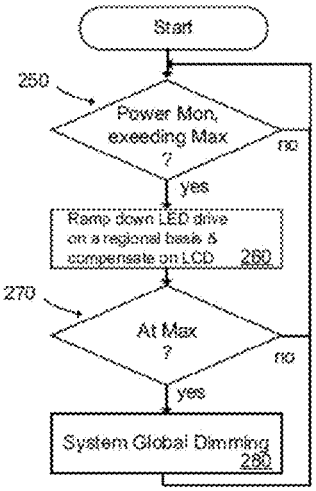
FIG. 2B is a flowchart of a power monitoring and modulation adjustment process according to an embodiment of the present invention.

FIG. 2B is a flowchart of a power monitoring and modulation adjustment process according to an embodiment of the present invention. For a particular frame, for example, the total system power is monitored (step 250). If the power exceeds the max power setting, then an adjustment is made to reduce the power. The adjustment is, for example, the above described ramping down of power while concurrently adjusting (further opening) a light valve (e.g., LCD pixels) to maintain the brightness of the resulting display (step 260). The ramping down is performed, for example, on a regional basis in combination with compensation at the LCD. If the result is a power level that still exceeds the Max power, then a system dimming (e.g., system global dimming, step 280) is initiated until the power level is below max power.

In various embodiments, the invention includes a number of techniques that can be employed either individually or combined for any of reducing, shifting, and/or re-allocating of power. Such techniques are performed, for example, in the Power State Machine (SM) module 135 and/or the HDR Algorithm module 115. These techniques include, but are not limited to, the following:

Large-scale feature detection—Detection of large scale features allows regions or portions of an image to be handled by more optimized processes. After detection of a large scale region, the more optimal processing, including power calculations, are applied to the LCD pixels and backlight power corresponding to the feature(s).

For example, large colour-washed areas tend to look significantly different in terms of shape and edge characteristics than high-brightness reflections (i.e., "glinting" or other specular phenomena). The differences can be taken advantage of to reduce power consumption by treating hard-white values in washed areas differently than those in specular areas.

A process for implementing the above, may include the steps of:

(a) identifying regions of strong high luminance content;

(b) characterizing the regions as "washed" or "specular;" and (c) applying different brightness calculations for the two (or more) regions to raise the brightness in specular areas and lower the brightness elsewhere.

In one embodiment, the invention comprises multiple categories of characterization (and multiple corresponding brightness calculations). The categories may comprise, for example, Hi washed, Med washed, Low washed, High specular, Med specular, and Low specular. In another embodiment, the categorizations may be determined on a level, e.g., 1 to 1000, and the categorization level may also be used to identify (e.g., a look-up table mapping categorization levels to brightness calculations) or modify brightness calculations (e.g., categorization levels being part of a formula for brightness calculation).

Figure 3A:
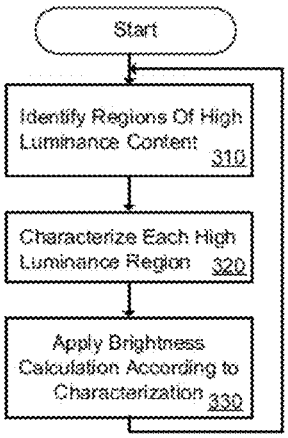
FIG. 3A is a flowchart of a power adjustment process according to an embodiment of the present invention.

FIG. 3A is a flowchart of a power adjustment process according to an embodiment of the present invention. At step 310, regions of high luminance content are identified. High luminance content may be identified, for example, by regions having more than a specified threshold (e.g., 80%) of pixels above a luminance threshold. Alternatively, the identification may be based on white content where regions having more than a specified threshold of primarily white content pixels are identified. At step 320, the identified regions are characterized. For example, the characterized regions may be several categories or a ranking of increasing luminaence (or, alternatively, increasing white content) within the identified regions. Then, based on the categorization, a different calculation is performed to adjust brightness for each categorized region (step 330).

In another embodiment, Contrast Detection ("salient feature" detection) may be utilized to identify areas or regions for increased or decreased brightness. Cinematographers use focusing techniques and motion to direct the human eye to specific parts of the screen at different times.

Focus techniques generally involve shrinking the depth of field to provide a sharp difference in contrast between the background and the in-focus subjects. This has the effect of isolating the subject matter of interest. In one embodiment, a process using variance in regional contrast to identify regions of interest can be used to lower power consumption by applying different scaling levels to foreground and background material. That is, relatively more power can be applied to regions where the viewer is expected to be looking at, while relatively less power can be applied to regions that are determined to be of less interest.

Although primarily applying to video content, some aspects of this feature may be applied to still photos. For example, a highly focused subject in the center of a still photograph displayed on a screen may have its brightness relative to a remainder of the photograph adjusted upward. In one embodiment, a location of a highly focused portion of the image may also be used in a determination of how much of a relative brightness adjustment should be made. For example, while many images intend to have the subject centered or near center, others do not. Still, if a well focused portion of a still image or video frame is also near center, the relative brightness of that object may be more certainly increased in brightness and thereby magnifying the intended focus of the viewer.

In another embodiment, the relative direction of focusing over a series of frames may also be considered. For example, if the focus is detected as centering in on a particular region or object of a set of frames, the brightness can be adjusted on that region/object sooner or with an increasing amount of brightness that increases, for example, at rate approximately equivalent to the rate of focusing occurring or rate of power on the region/object.

Figure 3B:
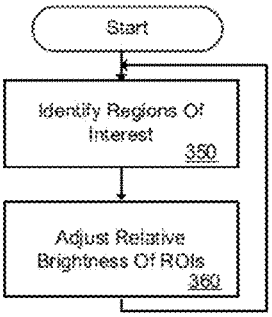
FIG. 3B is a flow chart of another power adjustment process according to an embodiment of the present invention.

FIG. 3B is a flow chart of another power adjustment process according to an embodiment of the present invention. At step 350, a Region Of Interest (ROI) is identified. A relative brightness level of the ROI is then adjusted (e.g., decreasing brightness of areas other than a focused ROI) (step 360).

In another embodiment, a Low Dynamic Range To High Dynamic Range (LDR2HDR) curve is shifted to enhance power use or when the video contents average luminance is very low during display of LDR expanded content. This is embodied, for example, in processing of a base HDR algorithm that includes the use of an LDR-to-HDR curve to expand LDR content (e.g., 8-bit content) into the HDR realm. Such processes occur, for example, in a HDR process module 115.

Figure 4A:
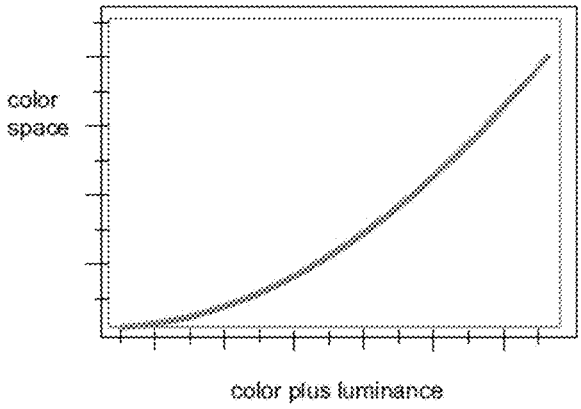
FIG. 4A is a graph illustrating a typical LDR2HDR conversion.

In a typical arrangement, displays use one global LDR2HDR table to move from color space to color plus luminance. A typical LDR2HDR content the curve may look like that illustrated in FIG. 4A.

When the calculations for the LED backlight drive strengths determine power is over a certain threshold, the LDR2HDR curve is adjusted for that frame. Shifting the curve in this manner effectively reduces the feature size undergoing the strongest brightness enhancement. It also causes LCD pixels in less bright regions to open up closer to maximum. The effect of this is to reduce overall power consumption.

In one embodiment, the shifting comprises moving the curve in the x-axis direction. In another embodiment, the shifting comprises changing a slope, locus, curvature, grade, or other criteria of the curve. In another embodiment, the shifting comprises replacing the LDR2HDR curve with a substitute curve. A substitute curve may be selected, for example, from a database of curves or formulas stored in memory.

Figure 4B:
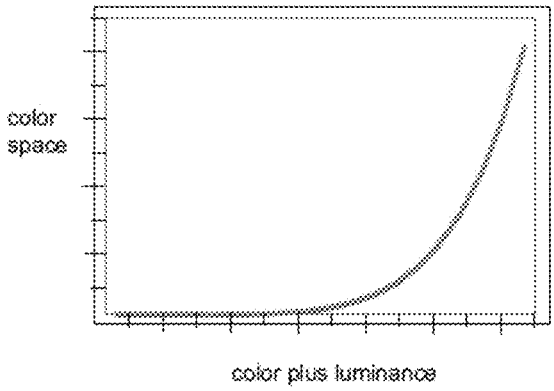
FIG. 4B is a graph illustrating a shifted LDR2HDR conversion according to an embodiment of the present invention.

Shifting of the LDR2HDR curve can be done globally, i.e., across the entire image frame, or it may be done locally, for specific regions. If done locally, the regions adjacent to the affected region are also adjusted to provide smoother transition between regions. FIG. 4B is an example of a shifted LDR2HDR curve according to an embodiment of the present invention. If two adjacent regions are each "shifted" independently, and particularly if one region is shifted "up" (e.g., higher in brightness) and the other is shifted "down" (e.g., lower in brightness), then boundary areas or transition areas between or in common with the adjacent regions are further adjusted to smooth the transition between the shifted adjacent regions.

Figure 5:
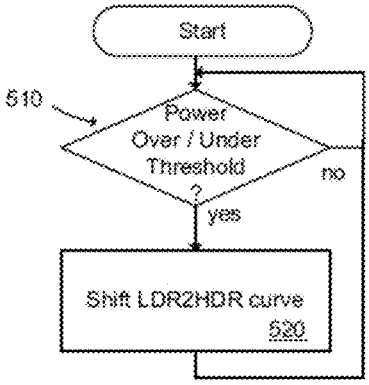
FIG. 5 is a flow chart of an LDR2HDR shifting process according to an embodiment of the present invention.

FIG. 5 is a flow chart of an LDR2HDR shifting process according to an embodiment of the present invention. At step 510, a power level of a display is monitored, and, if the power level is either over or under a predetermined threshold, an LDR2HDR curve of the display is shifted. The shift may occur moving "forward" (e.g., from a curve like FIG. 4A to a curve like FIG. 4B) if the power level is above a high threshold. The shift may occur moving in "reverse" (e.g., from a curve like FIG. 4B to a curve like FIG. 4A) if the power level is below a low threshold. The thresholds may be set such that the display operates with the least amount of power, but also in a range in which the display produces a predetermined minimum level of dynamic range. The thresholds may also be set with an amount of hysteresis so that the display does not switch back and forth between curves at a frequency that might introduce new artifacts.

Figure 6:
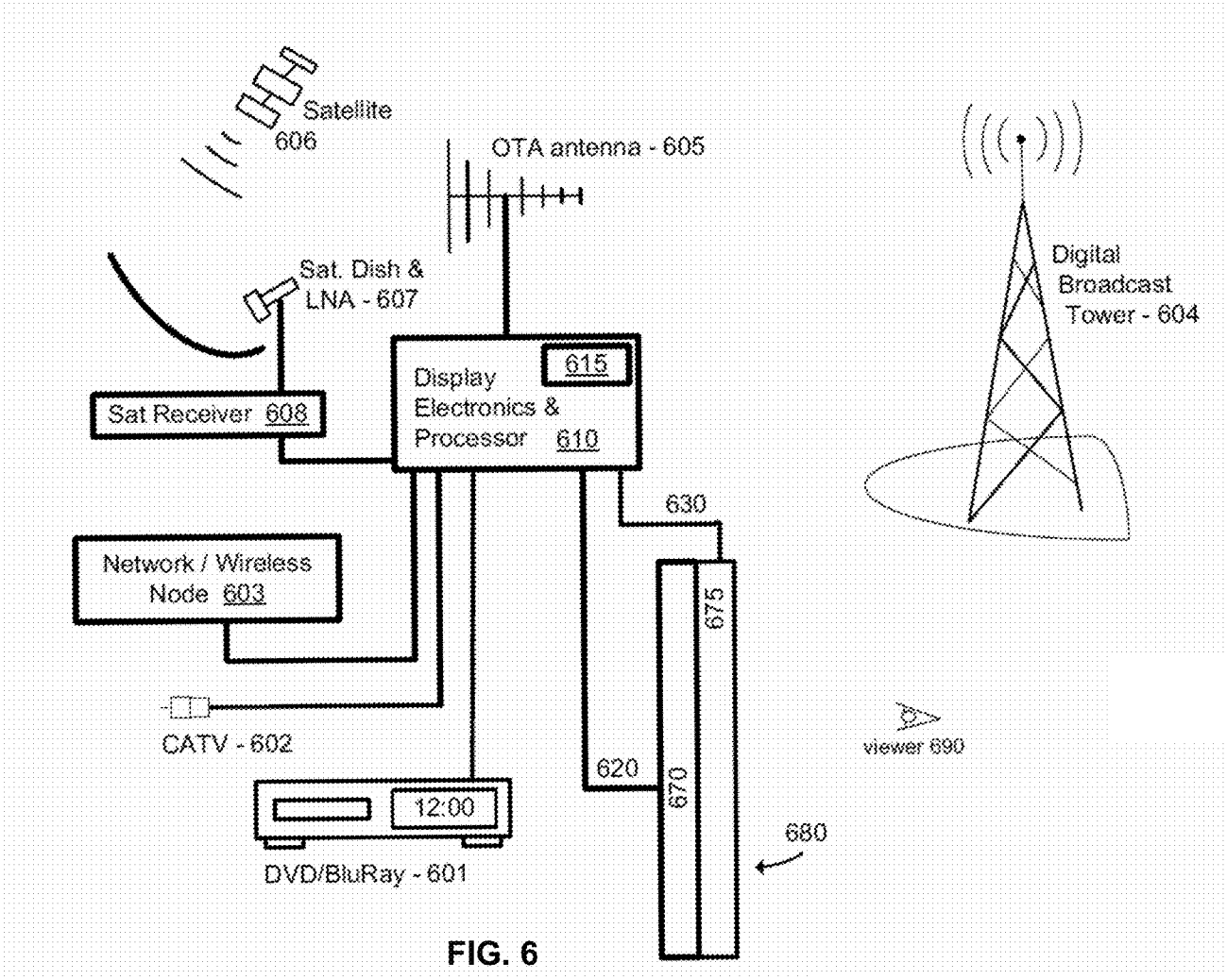
FIG. 6 is a block diagram of various system implementations according to various embodiments of the present invention.

FIG. 6 is a block diagram of a system implementation according to various embodiments of the present invention. Display electronics and processor 610 are configured according to one or more embodiments of the present invention. Display electronics & processor 610 receives RGB signals from any of a number of sources including, but not limited to, media players (e.g., DVD/Blu-ray 601), a cable TV (CATV) connection or box, a network appliance (e.g., network/wireless node 603), satellite receiver 608, or an Over-The-Air (OTA) antenna 605 (and related decoding of the OTA signal).

In operation, for example, a digital broadcast is transmitted from a digital broadcast tower 603, received by an the OTA antenna 605, and decoded by, for example, an ATSC receiver—not shown. The decoded signal comprises an RGB signal input to the Display Electronics and Processor 610. The display Electronics and Processor 610 include a memory 615 for storage of data and programs for implementing one or more of the techniques and/or processes described herein. For example, The Display Electronics and Processor 610 include processing that performs downsampling of LCD pixels, computes maximum, minimum, and average luminance values, defines Matrix power resolutions, calculates power, and defines system max power (which may be, for example, a physical limitation on the overall electronics of a display, or, as another example, may be an arbitrary number set to establish a maximum power consumption of the display).

The Display Electronics and Processor 610 may be further configured, for example, to monitor power consumption and make adjustments such as ramping down power simultaneously with compensatory LCD adjustments, and to perform system (or global) dimming in response to further power reduction requirements (e.g., to reduce power below a max power). The max power may be implemented with an amount of hysteresis to prevent minor changes in power from re-triggering the processes of the present invention.

The Display Electronics and Processor 610 may be yet further configured, for example, to identify regions of interest and to adjust relative brightness in each of those regions. The regions of interest may be, for example, areas of image focus, de-focus, strong white content (e.g., white content above a white content threshold) and the characterization of each region and the application of a brightness or other adjustment based on the characterization. The Display Electronics and Processor 610 may also be configured to curve shift or substitute LDR2HDR curves (or other features, e.g., color space curves, etc.) for the expansion of LDR data.

Ultimately, The Display Electronics and Processor 610 provides outputs 620 and 630 which respectively control a backlight 670 and a front modulator 675. The backlight is, for example, a backlight that comprises an array of LED clusters, each cluster being individually controllable as to at least one of brightness, PSF, and color. The backlight may be comprised of any number of any type of light sources, including light sources based on any of LEDs, fluorescents, phosphors, incandescents, OLEDs, nanotubes, and other light sources. The front modulator is, for example an array of light valves, such as, for example, an LCD panel. The combination of backlighting and front modulation, adjusted according to the present invention, results in an image or video displayed on a surface 680 of the front modulator 675 that is viewable by a viewer 690.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents which operate in a similar manner. For example, when describing an LCD panel, any other equivalent device, such as an arrangement of light valves constructed from non-LCD materials, or other devices having an equivalent function or capability, whether or not listed herein, may be substituted therewith. Furthermore, the inventors recognize that newly developed technologies not now known may also be substituted for the described parts and still not depart from the scope of the present invention. All other described items, including, but not limited to LEDs, processing modules, memory, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/−, micro-drive, and magneto-optical disks, ROMs, RAMs, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications. Ultimately, such computer readable media further includes software for performing the present invention, as described above.

Included in the programming (software) of the general/specialized computer or microprocessor are software modules for implementing the teachings of the present invention, including, but not limited to, calculating power, calculating white areas, identifying focused and unfocussed regions, identifying a level of focus, white wash, or other characteristics, selecting formulas based on image data, applying formulas for the adjustment of power level, brightness, and modulation (e.g., spatial modulation of backlight light sources and/or modulation of LCD pixels), and the display, storage, or communication of results according to the processes of the present invention.

The present invention may suitably comprise, consist of, or consist essentially of, any of element (the various parts or features of the invention) and their equivalents as described herein. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of claims to be included in a subsequently filed utility patent application, the invention may be practiced otherwise than as specifically described herein.

By way of further examples, in various embodiments, the invention comprises, and may be embodied, as, for example:

The invention claimed is:

1. A display, comprising:

a premodulator device including a plurality of individually controllable light sources and being configured to produce a first modulated light according to an image to be displayed, each of the individually controllable light sources being associated with at least one of a plurality of regions of the image to be displayed;

a primary modulator device illuminated by the first modulated light and configured to further modulate the first modulated light to produce further modulated light carrying the image to be displayed; and a controller coupled to the premodulator device and the primary modulator device, the controller being configured to evaluate image data representative of the image to be displayed to determine power information associated with each of the regions, to compare the power information to a maximum threshold power value, and when the power information indicates an exceedance of the maximum threshold power value for a particular region, to simultaneously calculate and implement a change in brightness of an area of the first modulated light associated with the particular region and a change in modulation by the primary modulator device so as to maintain brightness levels of the image to be displayed consistent with the image data, and wherein at least one region of the image to be displayed is adjusted in brightness relatively more or less than other regions of the image to be displayed.

2. The display according to claim 1, wherein the at least one region comprises a region based on content.

3. The display according to claim 1, wherein the at least one region comprises a region based on a relative amount of white light content.

4. The display according to claim 1, wherein the at least one region excludes regions of the image without 3 primary color content.

5. The display according to claim 1, wherein the at least one region comprises a first region that is increased in brightness relatively more than other regions of the image and a second region increased in brightness relatively more or less than the first region.

6. The display according to claim 1, wherein adjustments of brightness are performed regionally across the screen based on large scale features, color/white content, and power consumption.

7. The display according to claim 1, wherein the adjustments in brightness in regions of the image containing hard-white values in washed areas are different than adjustments in specular glinted regions of the image.

8. The display according to claim 1, wherein regions where the brightness adjustments are to be made are selected based on directorial input comprising regions of interest or content in the regions of interest which a director intended a viewer's attention to be focused.

9. The display according to claim 1, wherein the image to be displayed comprises a plurality of regions and a brightness adjustment is separately calculated for each region.

10. The display according to claim 9, wherein adjustments of brightness are performed based on large scale features, color/white content, and power consumption.

11. The display according to claim 9, wherein adjustments in brightness in regions of the image containing hard-white values in washed areas are different than adjustments in specular glinted regions of the image.

12. The display according to claim 9, wherein regions where the brightness adjustments are to be made are selected based on directorial input comprising regions of interest or content in the regions of interest where a viewer's attention is intended to be focused.

13. The display according to claim 9, wherein adjustments in brightness in regions of the image containing foreground imagery are adjusted different than regions of the image containing background imagery.

14. The display according to claim 1, wherein the display comprises a motion picture display and adjustments of brightness are performed across a plurality of regions of a frame image to be displayed and the adjustments are made in the frame image in consideration of providing a smooth transition between frame images of a scene.

15. The display according to claim 1, wherein the premodulator comprises an adjustable Point Spread Function (PSF).

16. The display according to claim 15, wherein the adjustable PSF is implemented with a cluster of narrowband light sources.

17. The display according to claim 1, wherein the premodulator comprises an array of clustered light emitting elements comprising an adjustable point spread function (PSF).

18. The display according to claim 1, wherein the change of brightness comprises a regional adjustment of brightness based on a degree of focus in the region.

19. The display according to claim 1, wherein the change in brightness and modulation are performed in consideration of an LDR2HDR curve as applied to a region of the image to be displayed.

20. The display according to claim 1, wherein the change in brightness and modulation result in primary modulator pixels in less bright regions of the image to open up closer to maximum.

21. The display according to claim 1, wherein the controller is additionally configured to:

determine whether the change in brightness of an area of the first modulated light and the associated change in modulation by the primary modulator device would produce an undesirable visual effect in the image to be displayed; and if it is determined that the change in brightness and the associated change in modulation would produce the undesirable visual effect, then implement a change in brightness over all areas of the first modulated light.

22. The display according to claim 1, wherein the power information comprises power consumption information.

* * * * *